United States Patent [19]

Pfister

[11] 4,232,434

[45] Nov. 11, 1980

[54] APPARATUS AND METHOD FOR ATTACHING STIFF CRIMPABLE MATERIAL TO A TENTER FRAME

[75] Inventor: Friedrich V. Pfister, Geneva, Switzerland

[73] Assignee: E. I. Du Pont de Nemours and Company, Wilmington, Del.

[21] Appl. No.: 909,554

[22] Filed: May 25, 1978

[51] Int. Cl.[2] ..... D06C 3/02

[52] U.S. Cl. ..... 26/86

[58] Field of Search ..... 26/76, 86, 96

[56] References Cited

U.S. PATENT DOCUMENTS

| | | | |
|---|---|---|---|
| 2,434,111 | 1/1948 | Hawley, Jr. et al. | 26/86 X |
| 2,489,275 | 11/1949 | Dungler | 26/93 |
| 2,577,880 | 12/1951 | Dodge | 26/72 |
| 2,723,438 | 11/1955 | Meier-Windhorst et al. | 26/86 |
| 2,766,503 | 10/1956 | Dungler | 26/72 |
| 2,961,735 | 11/1960 | Mohring | 26/86 |
| 3,029,491 | 4/1962 | Mohring | 26/86 |

FOREIGN PATENT DOCUMENTS

| | | | |
|---|---|---|---|
| 656685 | 2/1938 | Fed. Rep. of Germany | 26/86 |
| 725423 | 9/1942 | Fed. Rep. of Germany | 26/86 |
| 911484 | 5/1954 | Fed. Rep. of Germany | 26/86 |
| 791431 | 9/1935 | France | 26/86 |
| 891236 | 3/1962 | United Kingdom | 26/86 |
| 971430 | 9/1964 | United Kingdom | 26/86 |

*Primary Examiner*—Robert Mackey

[57] ABSTRACT

An apparatus for supplying and attaching stiff crimpable sheet material at its selvedges to pin chains of a tenter frame includes an overfeed means for squeezing the material at each selvedge into a wavy shape and a pinning brush having a peripheral surface that corresponds to the wavy shape of the selvedge of the material. The pinning brush synchronously moves with the selvedge of the material so that the crests and valleys of the peripheral surface of the brush are maintained in alignment with valleys and crests, respectively, of the selvedge.

1 Claim, 3 Drawing Figures

APPARATUS AND METHOD FOR ATTACHING STIFF CRIMPABLE MATERIAL TO A TENTER FRAME

DESCRIPTION

1. TECHNICAL FIELD

This invention relates to overfeeding sheet material to a tenter frame for treatment which involves shrinkage of the sheet in at least the machine direction. More particularly, it relates to an overfeed system adapted to transfer a stiff sheet to a tenter frame for uniform thermal retraction and to the corresponding process for overfeeding the stiff sheet.

2. BACKGROUND ART

Flexible sheet materials, such as lengths of fabric, are customarily dried or relaxed on tenter frames. In a common form of these frames, the continuously advancing sheet is pressed by cylindrical brushes upon moving parallel rows of pins along each selvedge so that the sheet is held under lateral restraint as it is heated or subjected to other desired treatment as it is passed through the apparatus. Usually the tenter frame is adjusted so that the rate at which the pins move is slower than the rate at which the sheet is supplied to the rolls, the rate of overfeed of the sheet being equal to the desired amount of thermal relaxation. The flexible sheet is thus crinkled slightly as it is pressed upon the pins, but relaxes to a flat configuration in response to the thermal treatment.

It has been found that conventional tenter frame equipment is not suitable for the relaxation of stiff sheets, such as spunbonded polypropylene. When sheets of spunbonded polypropylene are overfed to the rows of pins, the selvedges of the sheets become intermittently disengaged from the pins in a manner which causes the sheets to relax in a very nonuniform way. Such sheets are not even completely flat when delivered from the tenter frame; moreover, they contain regions of differential shrinkage potential with respect to any further heat treatment of the sheet. Such nonuniformly relaxed sheets are likely to warp when heated again to form bubbles, edge waves, and ripples running in the machine direction of the stiff sheet. The nonuniformly relaxed sheets cause defects when they are used as a backing material for carpets or in other end uses which require that the stiff sheets continue to lay flat after heat treatment.

DISCLOSURE OF THE INVENTION

The apparatus of this invention is one for overfeeding sheet material to a tenter frame having parallel rows of pins projecting from pin plates mounted on tenter chains. The rows of pins are spaced to hold the sheet at its selvedges. The apparatus, which is adapted to handle stiff crimpable sheets of material, is a system having at each selvedge an overfeed device comprising meshing upper and lower toothed belts adapted to receive the flat sheet material above the plane of the tenter chains, squeeze the sheet into a wavy shape serpentine configuration having crests and valleys at each selvedge, and deliver the sheet to the plane of the tenter chains. The apparatus has a pinning brush mounted adjacent to the upper belt in position to press the selvedge of the sheet against the pins. The pinning brush has a structured bristle surface with crests and valleys maintained in alignment with the valleys and crests, respectively, of the sheet material, and in this manner functions to press the wavy selvedges of the sheet all along its undulating surface in its valleys onto the pins of the tenter chains.

BEST MODE

Figure 1:
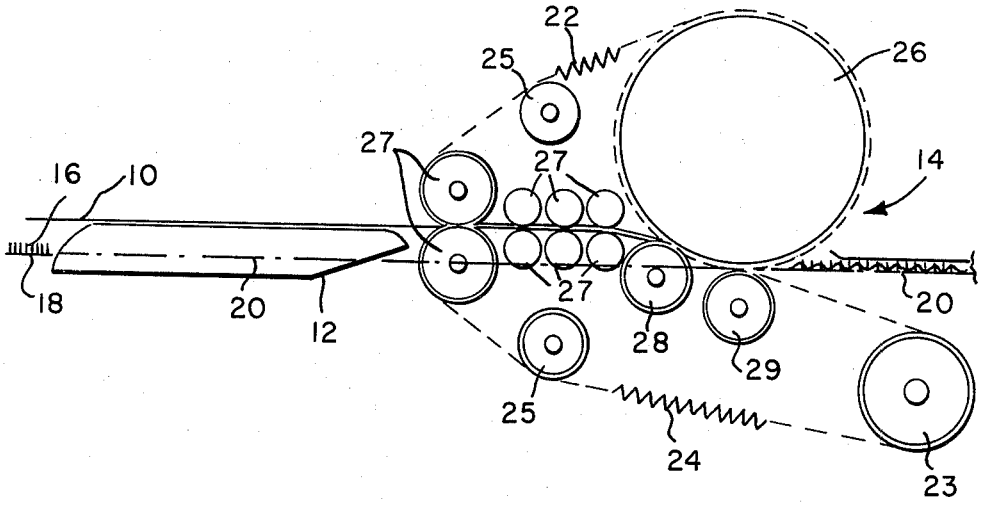
FIG. 1 is a side view of an overfeed device of the invention.
Figure 3:
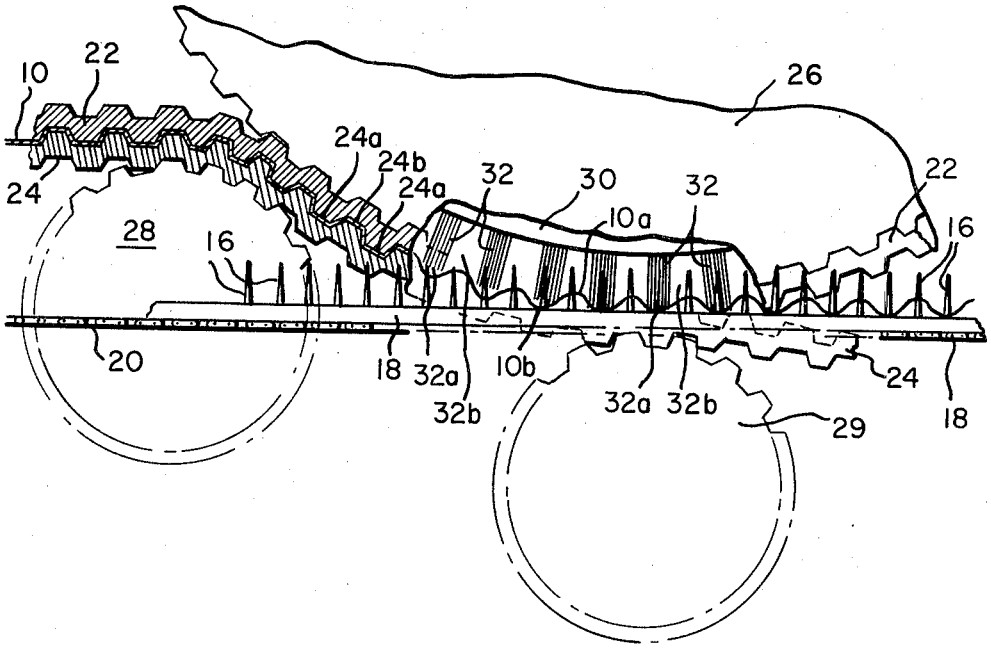
FIG. 3 is an enlarged detailed view of a portion of FIG. 1 showing the relationship of the bristles to the belts and the wavy selvedge edge of the material.
Figure 2:
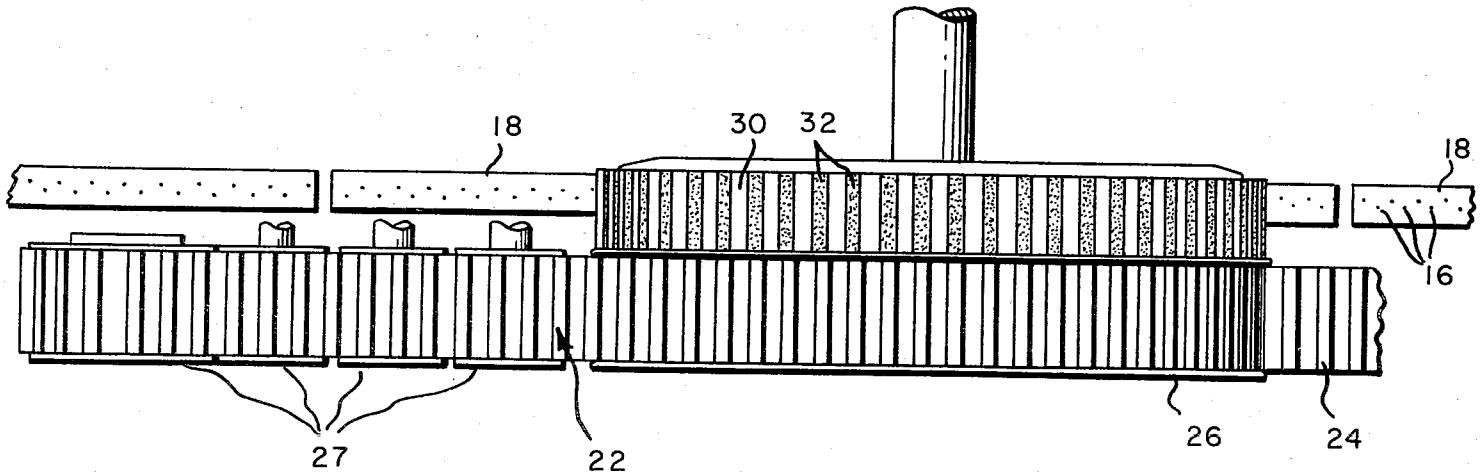
FIG. 2 is a plan view of the overfeed device of FIG. 1 also showing the structured pinning brush.

As shown in the drawings, a sheet of spunbonded polypropylene 10 is fed from a source (not shown) and passes over support table 12 to an overfeed device generally designated 14 which presses each selvedge of the sheet onto pins 16 projecting from plates 18 mounted on tenter chain 20. The complete system includes two of the overfeed devices, identical in design except that they are mirror images of one another, one mounted at each side of the tenter frame. In the drawings, only the overfeed device at one side of the tenter frame is shown and described.

The overfeed device comprises upper toothed belt 22 meshing with lower toothed belt 24, each belt being toothed on both sides and the lower toothed belt being driven by toothed roll 23. The upper belt passes around wheel 26, and while approaching the bottom of this wheel in the machine direction is held firmly in contact with the wheel and the lower belt by means of guide rolls 28 and 29 pressing upward against the lower belt 24, guide roll 29 being mounted directly below the bottom of the wheel 26. Other guide rolls 27 hold the upper and lower belts together in a horizontal path approaching the pinning wheel, while spring-loaded tension wheels 25 keep each of the belts taut. Pinning brush 30 is mounted adjacent to the upper belt 24 on the outer side of wheel 26 and is positioned so that the outer edge of the brush is in alignment with the selvedge (outer edge) of the sheet 10. The pinning brush is formed of spaced groups of nylon bristles 32 and is mounted on the same shaft as wheel 26 with which it turns synchronously. The pinning brush 30 has a structured bristle surface with crests 32a and valleys 32b in precise alignment with the crests 24a and valleys 24b of the teeth of the upper toothed belt 22. The structured surface of the brush 30 results from the uniformly spaced groups of nylon bristles 32 that extend outwardly from the brush.

The tenter chains are mechanically coupled to an A.C. motor (not shown) which is electrically linked to an identical motor acting on a P.I.V. drive (not shown) which turns a pull roll (not shown) for feeding the material from its source and is further linked with another P.I.V. drive (not shown) which drives toothed roll 23 of the overfeed device.

Although the various pulleys, belts or like mechanical means have not been completely illustrated in the drawings or completely described in the specification for driving or supporting the various rotating parts and conveyors in their desired or required speeds or with the rotation indicated by the direction arrows, it is to be appreciated that such elements and descriptions have been omitted to keep the drawings and the description succinct and to avoid the introduction of matters which are well known expedients in the art. The mechanical driving means and various support frames which are used are conventional and merely involve the application of well known mechanical principles.

In operation, the sheet 10 is fed over the support table 12, after which it is grasped at each selvedge by the pairs of toothed belts 22, 24. The meshing belts squeeze the sheet into a wavy-shaped serpentine configuration having crests 10a and valleys 10*b* at each selvedge and the sheet is then fed downwardly to the plane of the tenter chains 20, where the wavy-shaped selvedges of the sheet are pressed onto the tenter chain pins 16 by the pinning brush 30. More particularly, the structured bristle surface of brush 30 has crests 32*a* and valleys 32*b* which are maintained in alignment with the valleys 10b and the crests 10*a*, respectively, of the sheet material to press the wavy selvedges of the sheet 10 all along its undulating surface in the valleys only onto the pins 16 of the tenter chain. The valleys 32b of the brushes are shown to clear the crests 10a of the crimped material.

The tenter pins are so spaced on the plates that the sheet is pinned at each crest 10*a* and each valley 10*b* along the wavy configuration of the selvedges. More particularly, the pins 16 are staggered in a double row, with one row pinning the crests and the other row pinning the valleys of the serpentine configuration at each side of the sheet. The toothed belts with their aligned pinning brushes are timed with the tenter chains synchronously by adjustment of the P.I.V. drives so that a tenter chain 16 pin is presented to each crest and to each valley of the sheet as it is pressed downward onto the tenter plates. Correspondingly, feed speed of the sheet material is set by adjustment of its P.I.V. drive to deliver the sheet to the toothed belt at an overfeed sufficient to compensate for conversion of the flat sheet into the wavy configuration. As the sheet is fed to the toothed belts the edges of the sheet are maintained in alignment by conventional guiding means (not shown).

It should be recognized that the hardness, flexibility, wear resistance, dimension (i.e. both tooth and bristle height), of the belts and of the brush are selected as a function of the sheet material properties to be processed through the overfeed system. These factors determine the penetration and amount of maximum overfeed to be achieved.

I claim:

1. In an overfeed system for supplying and attaching stiff crimpable material at its selvedges to the pin chains of a pin tentering machine that includes means for forwarding the material from a source to an overfeed means for squeezing the material at its selvedges into a wavy shape having crests and valleys and forwarding the material to the plane of the pin chains, comprising upper and lower endless toothed belts pressed together through which the material passes, the improvement comprising a rotatable cylindrical brush formed of spaced groups of bristles located adjacent said overfeed means at each selvedge of the material and above said pin chain with said bristles projecting below the points of the pins, in which said brush has a peripheral surface with crests and valleys corresponding to crests and valleys imparted to the material by the overfeed means, said crests of said brush engage the valleys of said material, and said valleys of said brush are clear of the crests of said material, and means for rotating the brush synchronously with the movement of the wavy shaped selvedge edge of the material so that the crests and valleys on the peripheral surface of the brush are maintained in alignment with the valleys and crests, respectively, on said material.

* * * * *